United States Patent [19]

Estebanell

[11] 4,271,564

[45] Jun. 9, 1981

[54] COMBER-CLEANER CARDING DEVICE

[76] Inventor: Juan B. Estebanell, Av. Dr. Fleming, 8 San Fructuoso Del Bages, Barcelona, Spain

[21] Appl. No.: 29,162

[22] Filed: Apr. 11, 1979

[30] Foreign Application Priority Data

Apr. 11, 1978 [ES] Spain ..... 235.283[U]

[51] Int. Cl.[2] ..... D01G 15/04

[52] U.S. Cl. ..... 19/100; 19/104; 19/107

[58] Field of Search ..... 19/98, 99, 100, 101, 19/104, 107, 113

[56] References Cited

U.S. PATENT DOCUMENTS

| | | | |
|---|---|---|---|
| 2,243,685 | 5/1941 | Schiessler | 19/100 |
| 2,810,163 | 10/1957 | Kyame et al. | 19/107 X |
| 3,036,343 | 5/1962 | Strang | 19/104 |
| 3,115,683 | 12/1963 | Reiterer | 19/107 X |
| 3,707,020 | 12/1972 | Stewart | 19/107 |
| 4,011,631 | 3/1977 | Estebanell | 19/100 |

*Primary Examiner*—Louis Rimrodt

*Attorney, Agent, or Firm*—Blum, Kaplan, Friedman, Silberman & Beran

[57] ABSTRACT

A carding device of the large rotating carding drum type including a comber-cleaner assembly particularly well suited for combing and cleaning universal flat cards is provided. The comber-cleaner including a worker roller and a stripper roller mounted for cooperation with the carding drum is disposed between a take-in roller and a card belt. The comber-cleaner assembly includes at least three curved plaque segments disposed over the worker roller for defining at least two channels for positioning at least two extractor blades for improved removal of residual short fibers and other impurities. A control strip deforms the web as it passes from the stripper roller to the worker roller.

9 Claims, 2 Drawing Figures

COMBER-CLEANER CARDING DEVICE

BACKGROUND OF THE INVENTION

This invention relates generally to an improved carding device, and in particular to a carding device having an improved comber-cleaner assembly for removing small sized residual impurities.

Carding devices including comber-cleaner assemblies are generally well known and are well suited for opening, combing and cleaning all of the known conventional natural and synthetic fibers. For example, one such device is illustrated in U.S. Pat. No. 4,011,631, issued on Mar. 15, 1977 in the name of Juan Barcons Estebanell. Carding devices of this latter type have been satisfactory as they increase the efficiency and yield of the carded fiber by maximizing the surface area of the carding drum during the combing and cleaning operation. However, all the residual impurities are not removed during the first combing operation.

Accordingly, it would be desirable to provide an improved carding device including a comber-cleaner assembly for maximum removal of residual impurities which are most difficult to remove.

SUMMARY OF THE INVENTION

Generally speaking, in accordance with the invention, a carding device including an improved comber-cleaner assembly for removal of residual impurities is provided. A carding device constructed and arranged in accordance with the invention includes a large rotating carding drum formed with a plurality of teeth, angularly oriented in the direction of drum rotation and a comber-cleaner assembly having a rotatable stripper roller and a rotatable worker roller mounted for cooperation with the carding drum. The comber-cleanser assembly is disposed between a take-in roller for picking up the fibers onto the carding drum and a card belt for transporting the cleaned and combed web and includes at least three curved plaque segments disposed about the circumference of the worker roller. Each curved plaque segment has a plurality of ridges and prongs for cooperating with the worker roller for opening, cleaning and combing the web.

A control strip is positioned between the stripper roller and the worker roller adjacent to the first plaque segment for deforming the web as it passes from the stripper roller to the worker roller. At least two extractor blades are provided in the channels between the plaque segments adjacent to a pneumatic removal opening for maximum removal of short fibers and other residual material from the web. The extractor blades are inclined towards the direction of the web and rotating worker roller. As the web travels past the plaque segments it is returned to the carding drum.

Accordingly, it is an object of this invention to provide an improved carding device.

Another object of the invention is to provide a carding device having an improved comber-cleaner assembly.

A further object of the invention is to provide an improved carding device particularly well suited for combing and cleaning universal flat cards.

Still another object of the invention is to provide an improved carding device capable of removing small fibers and residual impurities.

Still a further object of the invention is to provide a carding device having an improved comber-cleaner assembly including at least two extractor blades.

Yet another object of the invention is to provide a carding device including an improved comber-cleaner assembly wherein at least two extractor blades are disposed for cooperation with a vacuum removal opening.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENT

Figure 1:
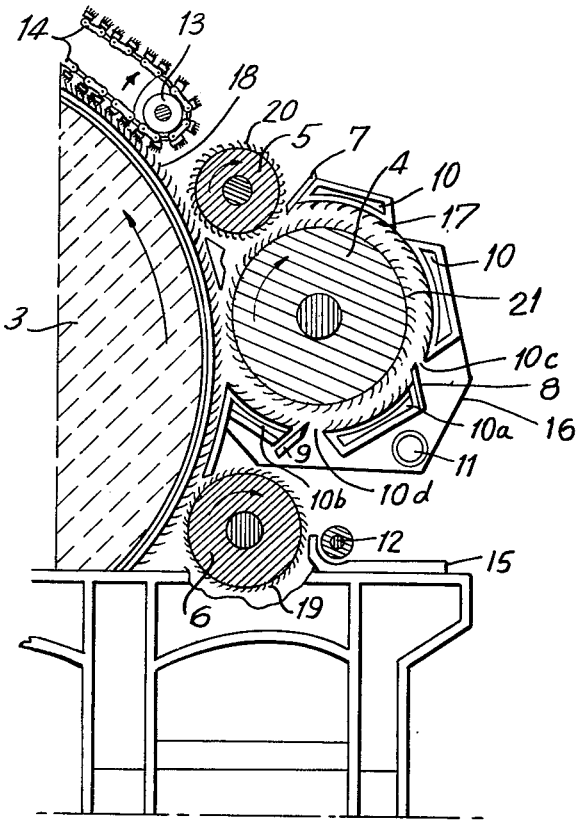
FIG. 1 is a partial side-sectional view of a carding device including a comber-cleaner assembly constructed and arranged in accordance with the invention.

In FIG. 1, a carding device including a comber-cleaner assembly constructed and arranged in accordance with the invention is illustrated. The carding device includes a large rotatably mounted carding drum 3 supported on a frame and table 15 and a rotatably mounted feed roller 12 and a rotatably mounted take-in roller 6 for feeding a card from table 15 to carding drum 3. The device also includes a comber-cleaner assembly mounted for cooperation with carding drum 3 having a rotatably mounted worker roller 4 for opening, cleaning and combing the web and a rotatably mounted stripper roller 5 for removing the web from carding drum 3.

The exterior semi-circle of stripper roller 5 carrying the web is exposed until stripper roller 5 approaches tangency with worker roller 4. At this point, worker roller 4 is surrounded by at least three curved plaque segments 10, **10*a* and 10*b* within a covering shell 16. A first channel 10*c* and a second channel 10*d* are formed between adjacent plaque segments 10 and 10*a* and 10 and 10*b*. Segments 10, 10*a* and 10*b* also form a convex run with worker roller 4** wherein the web is opened, cleaned and combed.

Carding drum 3 rotates in a counterclockwise direction and each of take-in roller 6, stripper roller 5 and worker roller 4 rotates in a clockwise direction. The interior curved surface of plaque segments 10, **10*a* and 10*b* are each formed with a plurality of teeth 17 inclined in the direction towards rotating worker roller 4. Carding drum 3 has teeth 18, take-in roller 6 has teeth 19 and stripper roller 5 has teeth 20, teeth 18, 19 and 20 are angularly oriented towards the rotational direction of the member. Worker roller 4 is provided with teeth 21 angularly oriented oppositely to the rotational direction of worker roller 4**.

A control strip 7 is disposed at the point of tangency between stripper roller 5 and worker roller 4 for deforming the web as it is fed onto worker roller 4 by stripper roller 5. Within the convex run between worker roller 4 and plaque segments 10, **10*a* and 10*b*, a conventional extractor blade 9 is disposed in channel 10***d* to enter into the path of the web prior to return to carding drum 3 as the web leaves worker roller 4. A first extractor blade 8 is disposed within the convex run at first channel 10*c*. First extractor blade 8 and second extractor blade 9 are inclined towards the direction of the approaching web on worker roller 4 for removal of impurities from the web which is expelled through first channel 10*c* and second channel 10*d* towards a pneumatic outlet 11 in covering shell 15.

The comber-cleaner assembly is disposed for cooperation with carding drum 3 between take-in roller 6 and a drive chain 14 which turns about a drive roller 13 for drive chain 14 to cooperate with carding drum 3 for transport of the cleaned and combed web.

Figure 2:
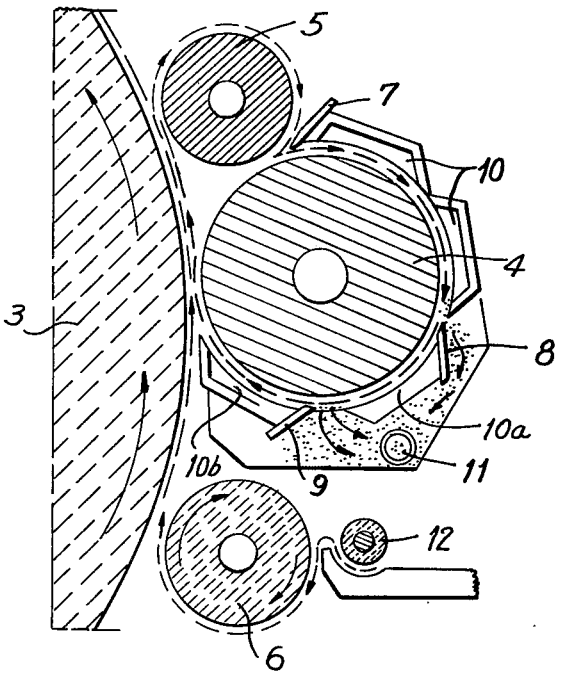
FIG. 2 is a schematic illustration depicting operation of the device illustrated in FIG. 1.

Referring now to FIG. 2, operation of the device constructed and arranged in accordance with the invention is shown. Heavy arrows outline the entire course run by the material to be cleaned and combed by the device.

The fibrous material to be cleaned and combed by the carding device enters at feed roller 12 where it is picked up by take-in roller 6 which is synchronized with and rotates in a direction opposite to that of carding drum 3. Thus, the web formed on the surface of take-in roller 6 is picked up by carding drum 3 where it is carried under segment 10*b*. The web is transported by carding drum 3 until it reaches a position upstream from worker roller 4 and contacts stripper roller 5 which has teeth 20 inclined in a direction towards carding drum 3 and rotates in a direction opposite to carding drum 3. Stripper roller 5 peels away the web from carding drum 3 and supports the web about the exposed exterior semicircle of stripper roller 5 until it reaches the tangential point for feeding onto worker roller 4.

As the web is passed from stripper roller 5 to worker roller 4 the fibers of the web have already begun to open. As shown in FIG. 2, control strip 7 is disposed at the tangent between stripper roller 5 and worker roller 4 so that the vertex of control strip 7 impinges on the web causing a folding or napping of the web. Starting at this time, worker roller 4 begins to pick up the web and carrying it through the concave run formed by curved plaque segments 10, 10*a* and 10*b* with teeth 17 cooperating with teeth 21 on worker roller 4 for opening, combing and cleaning the web.

At this time, the web is worked on by teeth 17 of segments 10, 10*a* and 10*b* and teeth 21 on worker roller 4, the fibers are being opened and combed and any impurities therebetween are being loosened. At this point in travel of the web through the concave run, the web reaches second extractor blade 8 for loosening and expulsion of impurities which pass through channel 10*c* for removal by the pneumatic removal through opening 11. This loosening of impurities is continued by first extractor blade 9 and the impurities pass through channel 10*d* towards opening 11 for completing the purification and removal of the most difficult residual impurities from the fibers of the web.

As the web is transported towards the end of the convex run under segment 10*b*, the web is once again picked up by carding drum 3. At this time, the web again begins an ascending course and passes under the level of stripper roller 5. The web then enters the belt region defined by driving chain 14 wherein completion of the work cycle of the flat cards occurs.

It is worth noting that the improvements in yield obtained by the structural improvements described herein represent a 30% increase in production. In addition, the structural improvements also result in a reduction of wear and tear on the interior plaque lining for the same output as previously obtained. Thus, constructing and arranging the carding device including a comber-cleaner assembly including at least two extractor blades results in the most efficient and economical way of obtaining flat cards. Moreover, the improved comber-cleaner assembly including at least three curved plaque segments and at least two extractor blades disposed about a vacuum opening can readily be applied to conventional carding devices for improved results.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. In a carding device of the type having a large rotatable carding drum having a first direction of rotation and provided with means for carrying a fibrous web on the surface thereof, feed means for feeding the fibrous web onto the carding drum, a comber-cleaner assembly mounted for cooperating with the carding drum, the comber-cleaner assembly including stripper means for removing the web from the carding drum, worker means and plaque segment means disposed adjacent said worker means for defining a semicircular run wherein the web is opened, cleaned and combed, the improvement which comprises plaque segment means including at least three plaque segments disposed in a covering shell for defining at least two channels between said segments and at least two extractor blades disposed in said channels between adjacent plaque segments for removing impurities from the web.

2. The device of claim 1, further including evacuating means for removal of impurities removed from the web and said extractor blades disposed vertically over said removal means.

3. The device of claim 2, wherein at least one of said extractor blades is disposed on the upstream side of said removal means and at least one of the other of said extractor blades is disposed downstream from said removal means.

4. The device of claim 2, wherein said removal means is a vacuum device.

5. The device of claim 4, wherein said assembly includes three curved plaque segments and two extractor blades.

6. The device of claim 5, wherein said feed means includes a rotatably mounted take-in roller disposed adjacent to said carding drum for feeding a web to said drum and a feed-roller for feeding the web from a table to said take-in roller.

7. The device of claim 5, wherein said stripper means is a stripper roller formed with a plurality of teeth angularly oriented in a direction opposite the rotation of said stripper roller and said worker means includes a worker roller disposed tangent to said stripper roller and said carding drum, said worker roller formed with a plurality of teeth angularly disposed in the direction of rotation of said worker roller, said stripper roller and said worker roller mounted for rotation in a second direction opposite to the rotation of said carding drum.

8. The device of claim 7, further including a control strip disposed at the point of tangency between said stripper roller and said worker roller for deforming the web as the web passes from the stripper roller to the worker roller.

9. The device of claim 7, wherein said plaque segments include a plurality of teeth angularly disposed in a direction opposite to the rotation of said worker roller for opening and combing the web as the web is carried through said semicircular run by said worker roller.

* * * * *